US006868789B1

(12) United States Patent
Basu

(10) Patent No.: US 6,868,789 B1
(45) Date of Patent: Mar. 22, 2005

(54) ADAPTOR FOR SECURING A BLASTING CAP INITIATOR

(75) Inventor: Mihir K. Basu, North Brunswick, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/249,135

(22) Filed: Mar. 18, 2003

Related U.S. Application Data

(60) Provisional application No. 60/365,011, filed on Mar. 18, 2002.

(51) Int. Cl.[7] ..... C06C 5/06

(52) U.S. Cl. ..... 102/275.12; 102/275.7; 102/275.2

(58) Field of Search ..... 102/275.12, 275.7, 102/275.2, 301, 304

(56) References Cited

U.S. PATENT DOCUMENTS 4,527,482 A * 7/1985 Hynes ..... 102/331
4,745,862 A * 5/1988 Arnell et al. ..... 102/424
5,007,661 A * 4/1991 Lenzen ..... 280/735
5,137,288 A * 8/1992 Starkey et al. ..... 279/42
5,167,476 A * 12/1992 Lafferty et al. ..... 408/240
5,316,324 A * 5/1994 Hufe. Jr. ..... 279/51
5,327,835 A * 7/1994 Adams et al. ..... 102/275.11
5,417,162 A * 5/1995 Adams et al. ..... 102/317
5,501,151 A * 3/1996 Thureson et al. ..... 102/275.7
5,689,083 A * 11/1997 Hadden ..... 102/275.2
6,272,996 B1 * 8/2001 O'Brien et al. ..... 102/275.11
6,318,271 B1 * 11/2001 Clark ..... 102/275.7

* cited by examiner

*Primary Examiner*—Michael J. Carone
*Assistant Examiner*—Troy Chambers
(74) *Attorney, Agent, or Firm*—Robert Charles Beam; John F. Moran

(57) ABSTRACT

The present invention provides a two-part adapter for more securely holding a blasting cap initiator in place in a demolition or munitions device. This adaptor is an insert component, generally cylindrical in shape and having an inner diameter capable of surrounding a blasting cap initiator, and a locking component. The insert component has a first threaded portion to mate with threaded cap wells of demolition and munitions devices, and a second portion with a plurality of flexible prongs arranged circumferentially around its inner diameter. The locking component is also generally cylindrical in shape and has a threaded inner surface to engage the insert component. The locking component also has a portion of decreasing inner diameter to approximately the inner radius of the insert component, and an outer surface with means to permit application of a turning torque. The device can be employed by screwing the insert portion into the threaded cap well of a demolition or munitions device, inserting a blasting cap initiator to a desired depth into the demolitions or munitions device. The locking component can then be placed over the blasting cap until the threaded portion of the locking component engages the insert component, and tightened until the locking component compresses the flexible prongs of the insert component, locking the blasting cap in place.

4 Claims, 1 Drawing Sheet

ADAPTOR FOR SECURING A BLASTING CAP INITIATOR

CROSS REFERENCE TO RELATED APPLICATIONS

This Application claims priority of U.S. Provisional Application No. 60/365,011, filed Mar. 18, 2002.

FEDERAL RESEARCH STATEMENT

[The invention described herein may be made, used, or licensed by or for the United States Government for Government purposes without the payment of any royalties thereon or therefore.]

BACKGROUND OF INVENTION

1. Field of the Invention

The present invention relates to an adapter for securing a blasting cap initiator. In particular, the present invention relates to a two-part adapter which will securely hold a blasting cap in position.

2. Description of Related Art

In the area of explosives, demolition and munitions devices employ a high energy explosive of some kind which must be initiated by some kind of primary explosive. On common method of doing so is with a blasting cap, a small charge of more sensitive material which can be detonated with pneumatic, electrical or heat energy and which will, in turn, detonate the larger mass of less-sensitive, high energy explosive.

One of the difficulties with using such blasting caps is that they are often inserted into the mass of high-energy explosive, but the depth to which they are inserted has some importance, as well as the intimacy of their contact with the explosive. In many devices, there are threaded cap wells provided to hold the blasting cap in position, but there are an array of different sizes and methodologies requiring an inventory of different components.

Notwithstanding this array of differing components, the blasting cap is often not sufficiently secured nor protected in the appropriate position and accidental ignition and incomplete ignition can result.

3. Brief Summary of the Invention

OBJECTS OF THE INVENTION

It is an object of the present invention to provide a device for more securely holding a blasting cap initiator in position in demolition and munitions devices.

It is a further object of the present invention to provide a device which will protect a blasting cap one positioned in a demolition or munitions device.

The other objects, features and advantages of the present invention will become more apparent in light of the following detailed description of the preferred embodiment thereof.

SUMMARY OF INVENTION

According to the present invention, there is provided a two-part adapter for more securely holding a blasting cap initiator in place in a demolition or munitions device, said adaptor comprising:

a demountable insert component, generally cylindrical in shape and having an inner diameter capable of surrounding a blasting cap initiator, said insert component further comprising:

a first portion having an outer diameter provided with a surface having screw threading to mate with threaded cap wells of demolition and munitions devices; and, a second portion having a plurality of flexible prongs arranged circumferentially around the inner diameter of said insert component; and, a demountable locking component; generally cylindrical in shape and having an inner diameter capable of operatively engaging said first insert component, said locking component further comprising:

a first portion having an inner diameter provided with a surface having a screw thread to mate with the threaded surface of said first portion of said insert component; and, a second portion having an inner diameter decreasing in radius from approximately the radius of said first portion of said locking component to approximately the inner radius of said insert component, and an outer surface provided with means to permit application of a turning torque; and wherein, said insert component can be affixed to the threaded cap well of a demolition or munitions device by means of said screw threading, a blasting cap initiator can be inserted into said demolitions or munitions device to a desired depth, and said locking component can be placed over said blasting cap initiator until the threaded portion of the inner diameter of said locking component engages the threaded portion of said insert component, and a turning torque may be applied to the means provided on the outer surface of said second portion of said locking component until the decreasing radius of the inner diameter of said second portion of said locking component compresses the flexible prongs of the second portion of said insert component against the blasting cap initiator, locking it in place.

DETAILED DESCRIPTION

Figure 1:
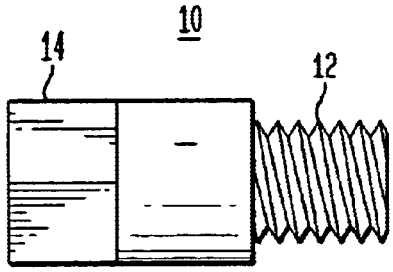
FIG. 1 shows the assembled two-part Adapter of the present invention.

According to the present invention, there is provided a two-part adapter 10 for more securely holding a blasting cap initiator in place in a demolition or munitions device. This adaptor 10 comprises a demountable insert component 12, and a demountable locking component 14. The insert component 12 is generally cylindrical in shape and has an inner diameter 16 capable of surrounding a blasting cap initiator. The insert component 12 further comprises a first portion 18 and a second portion 20 along its length 22, as shown more clearly in FIG. 2.

Figure 2:
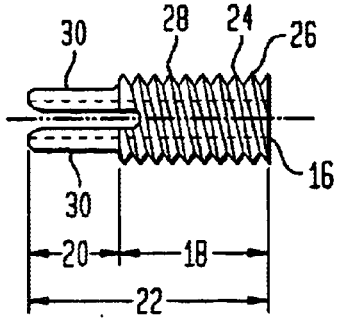
FIG. 2 shows the insert portion of the Adapter of the present invention.

As seen in FIG. 2, the first portion 18 has an outer diameter 24 provided with a surface 26 having screw threading 28 to mate with threaded cap wells of demolition and munitions devices. The insert component 12 also has a second portion 20 which has a plurality of flexible prongs 30 arranged circumferentially around the inner diameter 16 of the insert component 12.

Figure 3A:
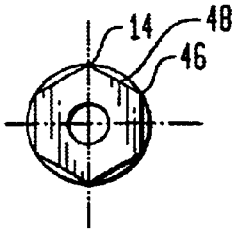
FIG. 3 shows the locking portion of the Adapter of the present invention.
Figure 3B:
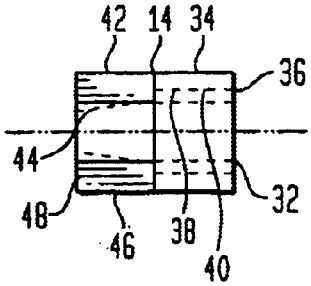
Figure 3C:
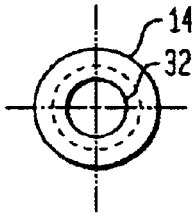

As seen in FIG. 3, particularly the side view of FIG. 3(*c*), the locking component 14 is generally cylindrical in shape and has an inner diameter 32 capable of operatively engaging the first insert component 12. As seen in FIG. 3(*b*), the locking component 14 further comprises a first portion 34 having an inner diameter 36 provided with a surface 38 having a screw thread 40 to mate with the screw threading 28 on the surface 26 of the first portion 18 of said insert component 12.

With continued reference to FIG. 3(*b*), the locking component 14 is further provided with a second portion 42 having an inner diameter 44 decreasing in radius from approximately the inner diameter 36 of the first portion 34 of the locking component 14 to approximately the inner diameter 16 of the insert component 12. The second portion 42 of the locking component 14 is also provided with an outer surface 46 provided with means 48 to permit application of a turning torque.

In use, the insert component 12 can be affixed to the threaded cap well of a demolition or munitions device by means of its screw threading 28. Then a blasting cap initiator can be inserted into the demolition or munitions device to a desired depth, and the locking component 14 can be placed over the blasting cap initiator until the screw thread 40 of the first portion 34 of the locking component 14 engages the screw threading 28 of the insert component 12. A turning torque may be applied to the means 48 provided on the outer surface 46 of the second portion 42 of the locking component 14 until the decreasing radius of the inner diameter 44 of the second portion 42 of the locking component 14 compresses the flexible prongs 30 of the second portion 20 of the insert component 12 against the blasting cap initiator, locking it in place.

Once the blasting cap is secured in place with the device of the present invention, it will prevent any accidental dislocation of the blasting cap and its position with respect to the explosive. The Adapter of the present invention was tested with loaded Rebar and Bolt Cutter (RBC) under both ambient and −25° F., with the following results:

Drop Test Adapter pointed end down No Failure

Firing Test RBC in Vertical and Horizontal orientation No Failure.

The Adapter of the present invention can be fabricated from many suitable materials, and the common fluorocarbon material Teflon® has been used successfully.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A two-part adapter for more securely holding a blasting cap initiator in place in a demolition or munitions device, said adaptor comprising:

a demountable insert component, generally cylindrical in shape and having an inner diameter capable of surrounding a blasting cap initiator, said insert component further comprising:

a first portion having an outer diameter provided with a surface having screw threading to mate with threaded cap wells of demolition and munitions devices; and, a second portion having a plurality of flexible prongs arranged circumferentially around the inner diameter of said insert component; and, a demountable locking component, generally cylindrical in shape and having an inner diameter capable of operatively engaging said first insert component, said locking component further comprising:

a first portion having an inner diameter provided with a surface having a screw thread to mate with the threaded surface of said first portion of said insert component; and, a second portion having an inner diameter decreasing in radius from approximately the inner diameter of said fit portion of said locking component to approximately the inner radius of said insert component, and an outer surface provided with means to permit application of a turning torque, and wherein, said insert component can be affixed to the threaded cap well of a demolition or munitions device by means of said screw threading, a blasting cap initiator can be inserted into said demolition; or munitions device to a desired depth, and said locking component can be placed over said blasting cap initiator until the threaded portion of the inner diameter of said locking component engages the threaded portion of said insert component, and a turning torque may be applied to the means provided on the outer surface of said second portion of said locking component until the decreasing radius of the inner diameter of said second portion of said locking component compresses the flexible prongs of the second portion of said insert component against the blasting cap initiator, locking it in place.

2. The adapter of claim 1 wherein the insert component and the locking component are fabricated from different materials.

3. The adapter of claim 1 wherein the insert component and the locking component are fabricated from the same material.

4. The adapter of claim 3 wherein the insert component and the locking component are fabricated from a fluorocarbon material.

* * * * *